US008459316B2

(12) United States Patent
Suero Castaño et al.

(10) Patent No.: US 8,459,316 B2
(45) Date of Patent: Jun. 11, 2013

(54) SAFETY CABINET FOR FILLING SELF-CONTAINED BREATHING APPARATUS BOTTLES

(76) Inventors: Maria Teresa Suero Castaño, Zalla (ES); Alberto Perez Rodriguez, Zalla (ES)

( * ) Notice: Subject to any disclaimer, the term of this patent is extended or adjusted under 35 U.S.C. 154(b) by 728 days.

(21) Appl. No.: 12/671,967

(22) PCT Filed: Jun. 11, 2008

(86) PCT No.: PCT/ES2008/000423

§ 371 (c)(1),
(2), (4) Date: Feb. 3, 2010

(87) PCT Pub. No.: WO2009/150260

PCT Pub. Date: Dec. 17, 2009

(65) Prior Publication Data

US 2011/0186173 A1 Aug. 4, 2011

(51) Int. Cl.
*B65B 1/04* (2006.01)
*B65B 67/12* (2006.01)

(52) U.S. Cl.
CPC ..... *B65B 67/1205* (2013.01)
USPC ..... 141/390; 141/3; 141/20; 141/97; 312/350

(58) Field of Classification Search
USPC ..... 141/3, 20, 38, 97, 130, 231, 390; 312/350
See application file for complete search history.

(56) References Cited

U.S. PATENT DOCUMENTS

| | | | | |
|---|---|---|---|---|
| 3,259,152 | A * | 7/1966 | Schimkat | 141/20 |
| 4,830,066 | A * | 5/1989 | Dresen et al. | 141/1 |
| 4,862,931 | A * | 9/1989 | Vella | 141/1 |
| 5,035,269 | A * | 7/1991 | Pytryga et al. | 141/1 |
| 5,322,092 | A * | 6/1994 | Howeth et al. | 141/3 |
| 5,404,921 | A | 4/1995 | Lamoreaux et al. | |
| 6,494,549 | B2 | 12/2002 | Van Daalwyk | |
| 7,000,650 | B2 * | 2/2006 | Desjardins et al. | 141/20 |
| 7,020,906 | B2 | 4/2006 | Cuffari, Jr. et al. | |
| 7,093,626 | B2 * | 8/2006 | Li et al. | 141/231 |
| 7,500,497 | B2 * | 3/2009 | Michel et al. | 141/2 |
| 2003/0180113 | A1 | 9/2003 | Udivich et al. | |

FOREIGN PATENT DOCUMENTS

| | | | |
|---|---|---|---|
| GB | 2360831 | Y | 10/2001 |
| JP | 10176798 | A | 6/1998 |
| JP | 2001324099 | A | 11/2001 |

OTHER PUBLICATIONS

English Translation of PCT International Preliminary Report on Patentability (7 pages).

* cited by examiner

*Primary Examiner* — Timothy L Maust
(74) *Attorney, Agent, or Firm* — Lucas & Mercanti, LLP

(57) ABSTRACT

Safety cabinet for filling self-contained breathing apparatus bottles comprising a housing body with high-strength walls, openable on its front and top sides and forming a work surface fitted with a plurality of tapered rubber rollers, linked at their narrow ends and arranged to form a bed of supporting rollers for the bottles to be filled, arranged horizontally and to which the respective filling taps are attached. The housing body is closed using a vertical front door and a horizontal top door.

9 Claims, 9 Drawing Sheets

SAFETY CABINET FOR FILLING SELF-CONTAINED BREATHING APPARATUS BOTTLES

This application is a 371 of PCT/ES2008/000423 filed Jun. 11, 2008, which application is incorporated by reference.

OBJECT OF THE INVENTION

This invention is in reference to a safety cabinet for filling self-contained breathing apparatus bottles.

FIELD OF THE INVENTION

This is the field of conditioning (filling) of bottles of compressed air or other gases used in the self-contained apparatus used in underwater activities and in special work on the surface.

BACKGROUND OF THE INVENTION

For the filling of compressed air bottles, installations equipped with safety resources, especially passive, are known, of great resistance and sturdiness, designed for the prevention of accidents resulting from possible leaks of said fluid and of breakage of the recipients themselves and which, due to their characteristics, are commonly known as bunkers. The construction and maintenance of said installations is, obviously, very elevated.

On the market there is a type of cabinet for the filling of bottles in which the bottles are inserted in vertical position and must be adjusted carefully in their orientation so that the filling can be done correctly. Normally, the cabinet in question accepts one type or size of bottle for filling (except in the case of readaptation), preferably, and this is not possible for paired bottles in what is known in the specialty as "twin bottles". Moreover, given the configuration of the installation, the operators of the cabinet in question are forced to adopt uncomfortable and tiring postures in their work.

There is, therefore, a need to dispose of a cabinet for the filling of compressed air bottles which eliminates the disadvantages mentioned.

BRIEF DESCRIPTION OF THE INVENTION

Bearing in mind the disadvantageous aspects of the previously known types of filling machines, which have been stated above, a cabinet has been designed which is easy to use with all types of bottles and for different values of filling air pressure. Characteristically, the bottles are inserted into the machine in horizontal position, which facilitates their handling and positioning for the filling phase.

The structure of the new cabinet is very sturdy, explosion proof, and the operators have effective bodily protection, thus complying with the law on job risk prevention.

To facilitate the explanation, this description is accompanied with drawings showing, for illustrative and non-limiting purposes, a case of realization of a safety cabinet for the filling of air bottles used in self-contained breathing apparatus according to the principles of the claims.

DETAILED DESCRIPTION OF THE INVENTION

Figure 1:
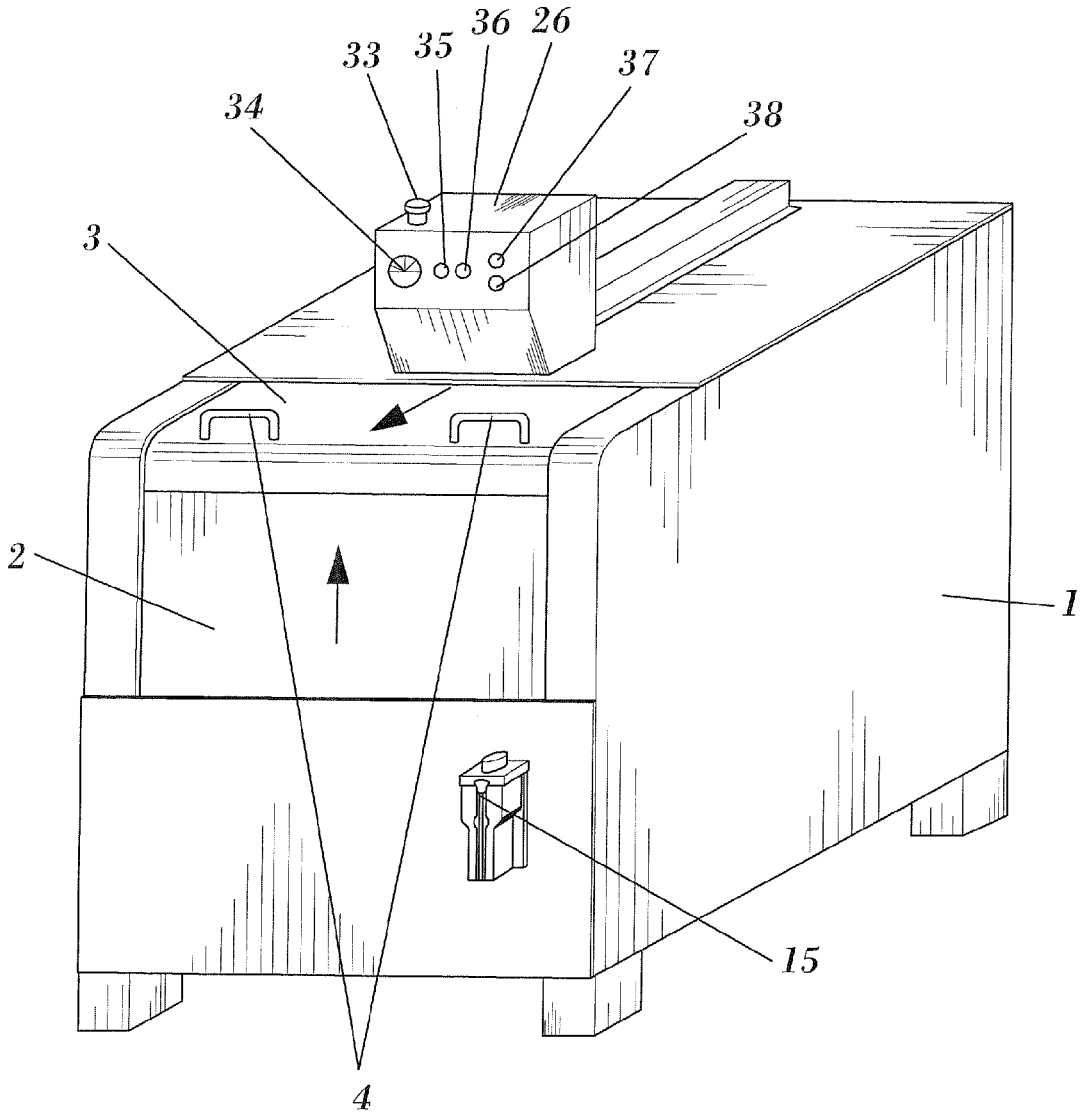
FIG. 1 shows a new safety cabinet in a closed state.
Figure 2:
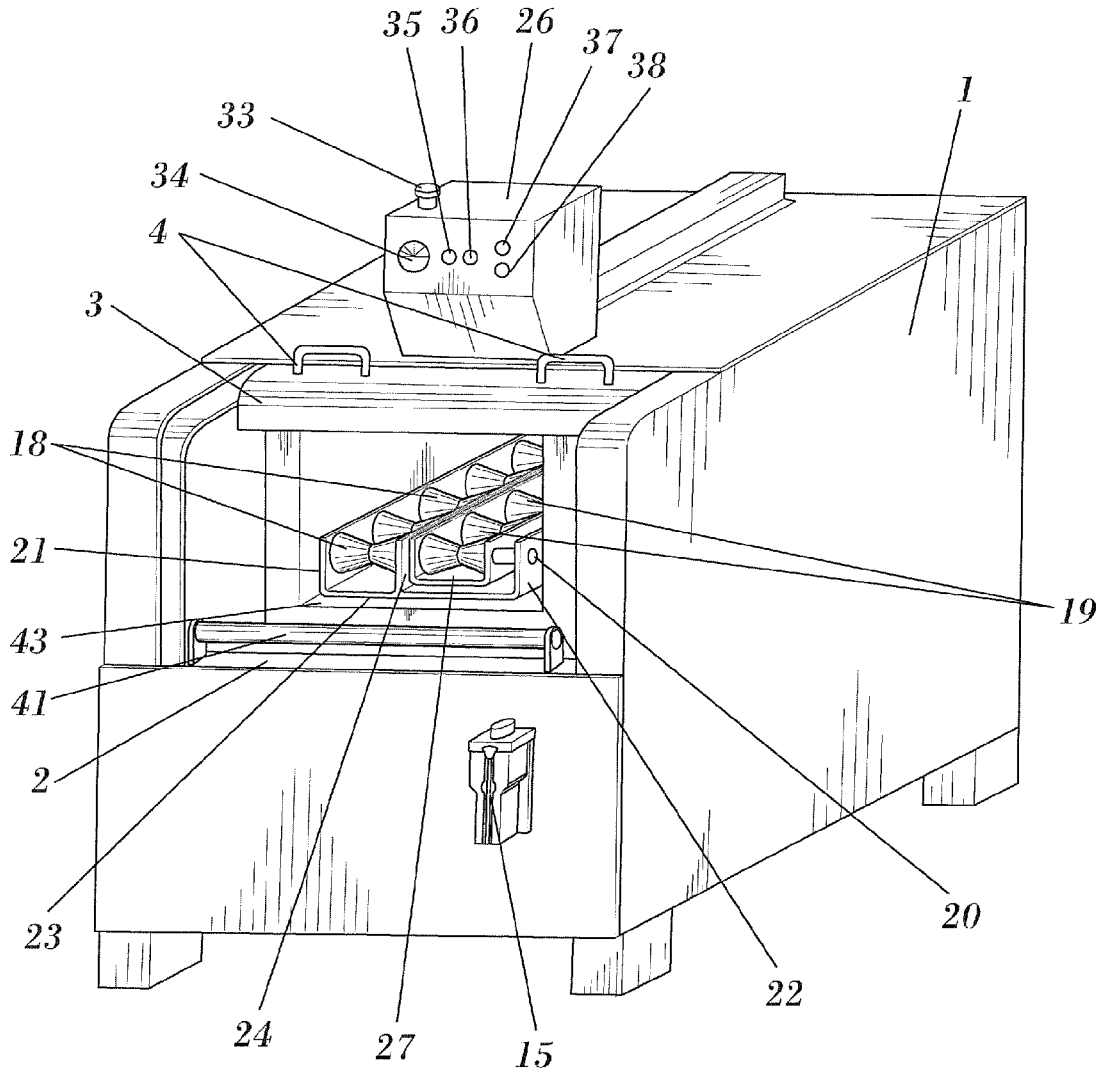
FIG. 2 shows the cabinet in an open state, prepared for use.

The elements designated with numbers in the drawings correspond to the parts indicated as follows.

The cabinet described consists of a box-shaped body (1) in general orthoedric shape, with walls made of a material of great resistance (in order to support, in case of the explosion of one or more bottles of compressed air, the stresses resulting from this incident).

Body (1) opens on its front vertical face and on its upper base, by which its utilization is verified and where the two doors (2), (3) for access to the interior are located.

Door (2) moves vertically on the plane of the front face, and is operated by a mechanism for its elevation and descent, which will be described.

Door (3) moves horizontally on the upper base of the body 1, sliding with rollers (3*a*) on two lateral guides, and equipped with two handles (4) for manual movement.

The movement of door (3), apart from the manual method indicated, can likewise be carried out with an electromechanical device that is known, such as with a nut (39), a lead screw and an electric motor (40). The door can also be folding or other type.

The operating mechanism of the front door (2) includes an electric motor (5), actuator of a transversal axle-shaft (6), the ends of which, sustained by bearings (7), carry the conical cog wheels (8), meshed with other wheels (9) attached to the lateral and vertical spindles (10).

The spindles (10), in their turning, determine the vertical movement of the nuts (11), attached to the supports (12) fixed to the front door (2) and which will produce the vertical movement of the same.

Conventionally, the heads of the spindles (10) rest with bearings (13) on the supports (14) on the upper and lateral parts of the body (1).

The vertical movement of the front door (2) could likewise be carried out with pneumatic or hydraulic cylinders, chain and/or belt mechanisms and similar.

The grease pump (15), located on one of the exterior sides of the body (1), serves for maintenance of the device, especially of the spindles (10).

Bottles (16), (17) which are to be filled with compressed air are inserted in horizontal position into the cabinet. Initially, they are allowed to rest on a transversal roller (41), located on the upper edge of the front door (2) and are then deposited by horizontal pushing, according to FIGS. 3 to 8, on sets of rollers (18), (19) of rubber or similar material, of low hardness and conical shape, associated two by two at their smaller bases (defining shapes of the known "diavolo"). This characteristic ensures the stability and virtual immobility of the bottles (16), (17) during the filling operation; it likewise ensures that no scratching occurs or other aggressions on the outer surface of the bottles (16), (17).

Rollers (18), (19) are mounted on fixed horizontal shafts (20), parallel and equidistant, sustained by the side faces (21), (22) of a common support (23) in a low box shape. Inside of it there is a partition (24) parallel to the faces (21), (22); thus, there is a section in E shape, which is passed through by the shafts (20).

One part (18) of the rollers can turn freely on the shaft sections (20) (fixed) located between the face (21) and the partition (24), and cannot move axially.

Another part (19) of the rollers is first contained inside of a support (27) in the shape of a channel of rectangular section, the side faces of which, provided with perforations (28), are passed through by the same fixed shafts (20).

The space defined between the partition (24) and the face (22) of the support (23) is greater in width than the distance between the face (21) and the partition (24) itself; thus, the length of the shaft sections (20) in this space is greater than that of each conical roller pair (19) and their support (27).

For this reason, support (27) can move, always parallel to itself, leaving exposed equivalent sections of the shafts (20). Consequently, the distances between the roller pairs (18), (19) mounted on the shafts (20) can be modified at will, according to the diameters of the bottles (16), (17) placed horizontally on them.

Alternatively, instead of the elastic rollers (18), (19) mentioned, forming a unit of support for the bottles (16), (17) oriented horizontally, a shelf or drawer could be used, sliding horizontally on guides and forming "beds" or elongated entries for receiving and sustaining the bottles (16), (17).

Figure 3:
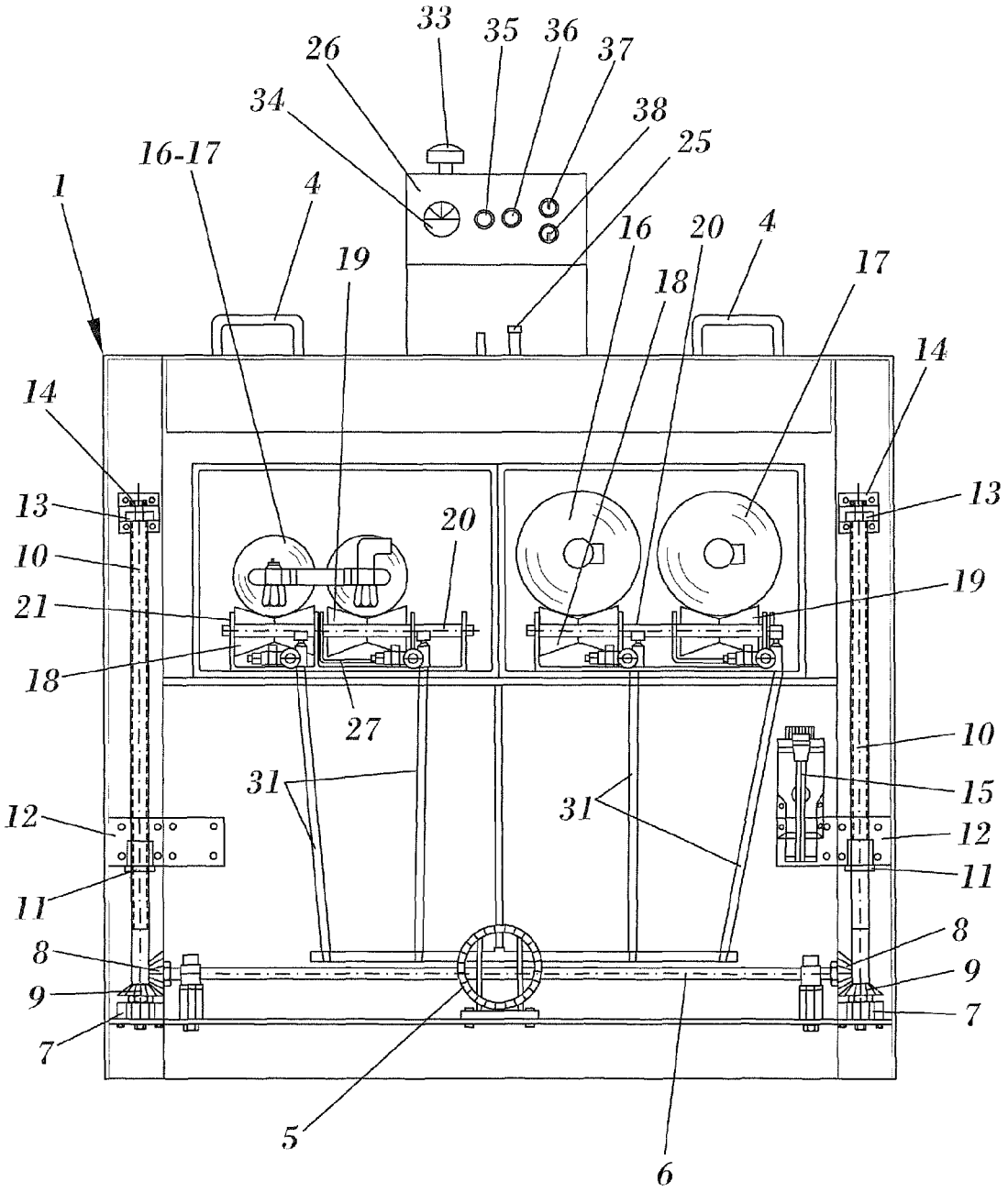
FIGS. 3 and 3*b* represent the internal configuration of the new safety cabinet for the filling of two pairs of bottles (16), (17), which in the example are, respectively, twin bottles and a pair of separate bottles, simultaneously or not.
Figure 3B:
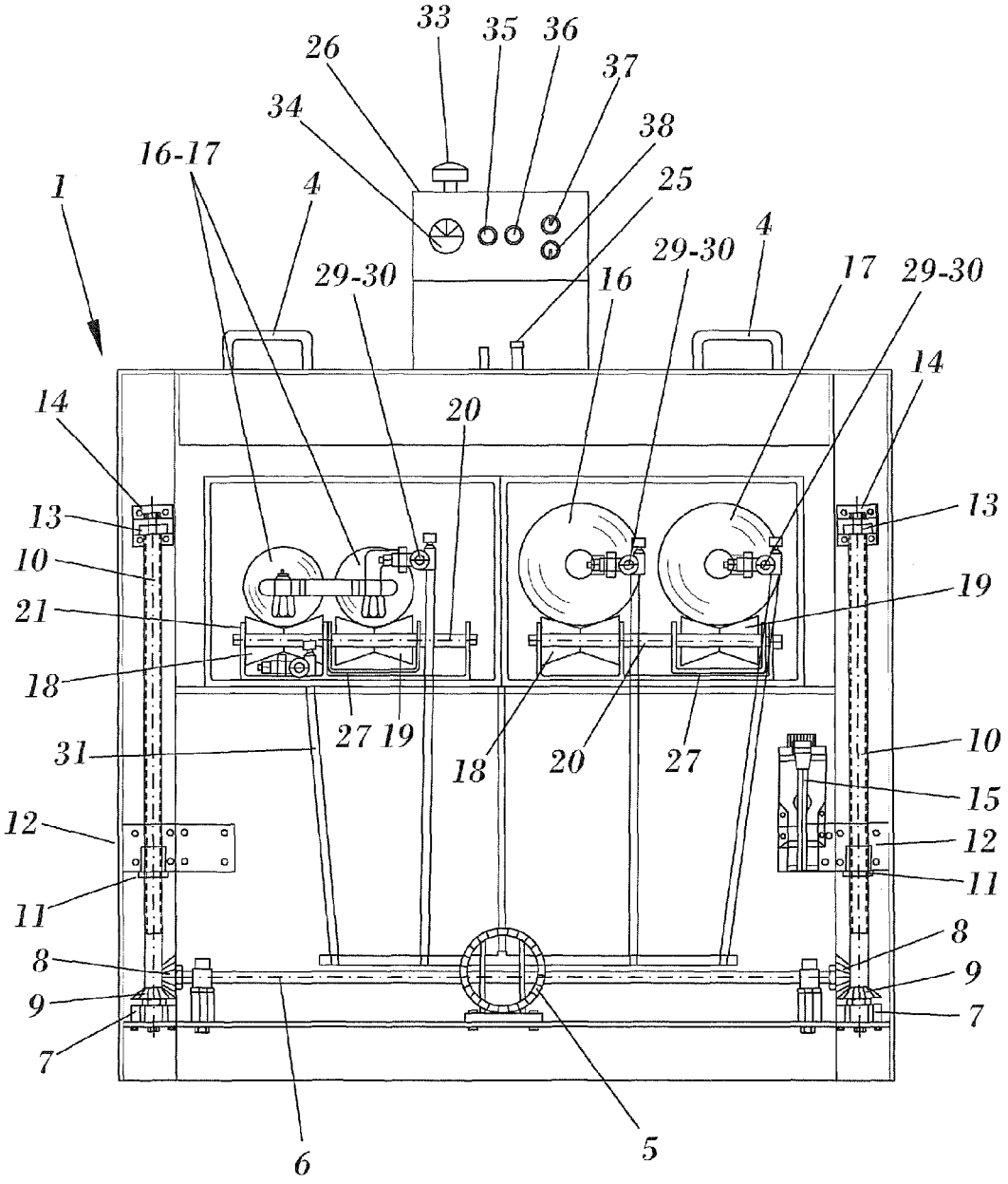
Figure 4:
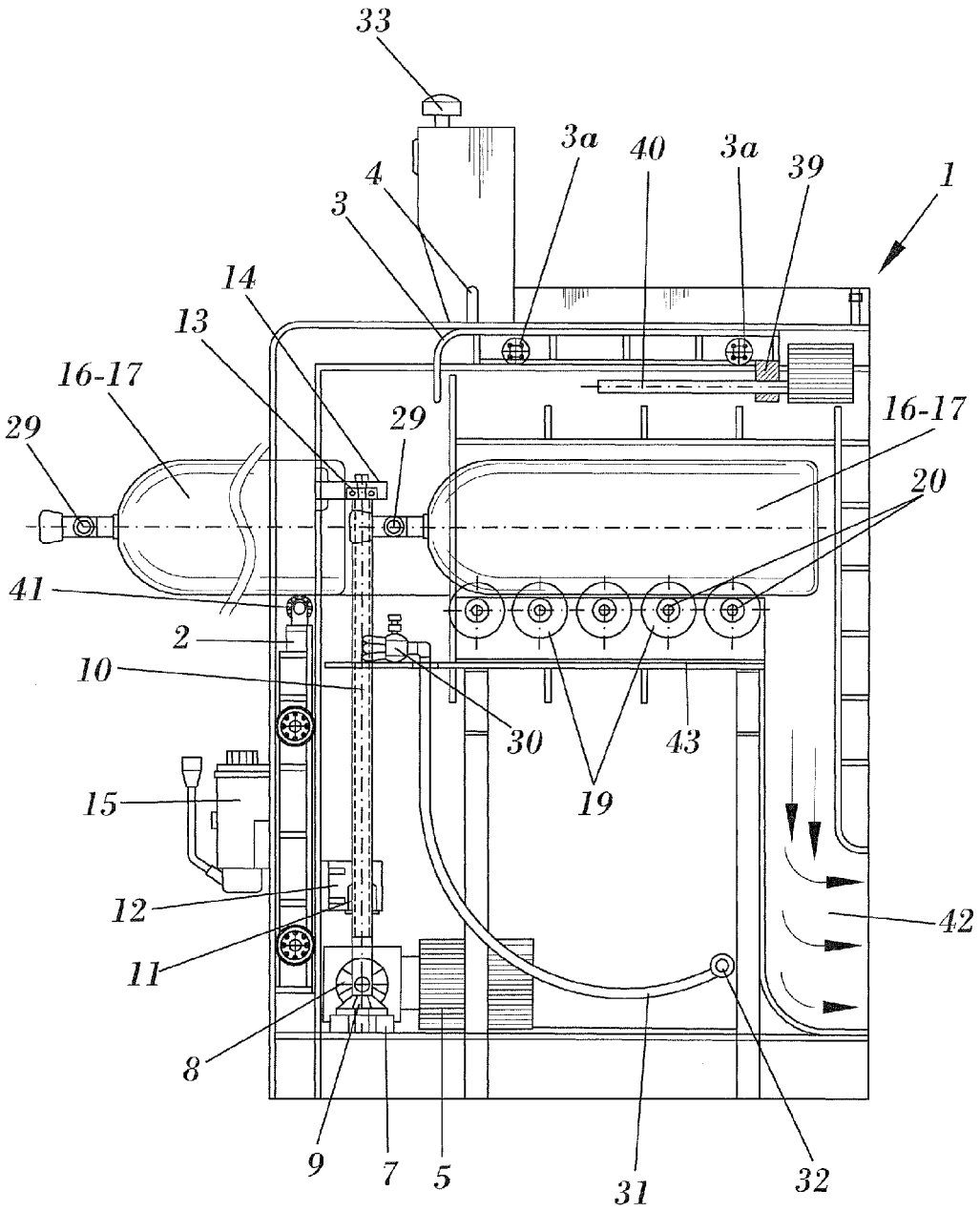
FIG. 4 shows the new cabinet with its front door (2) open and the filling tap (30) at rest.
Figure 5:
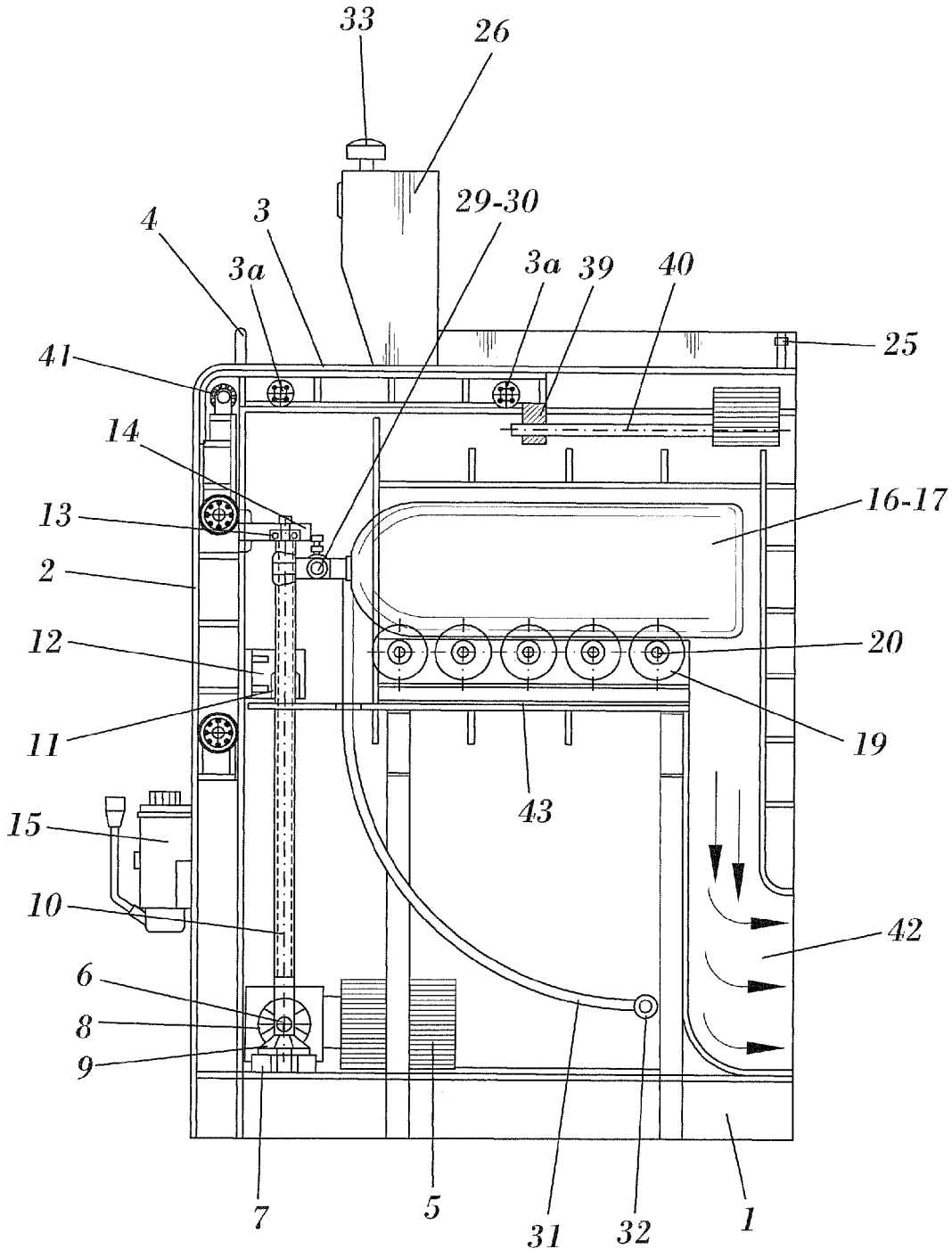
FIG. 5 shows the new cabinet with the front door (2) closed and the filling tap (30) in operation.
Figure 6:
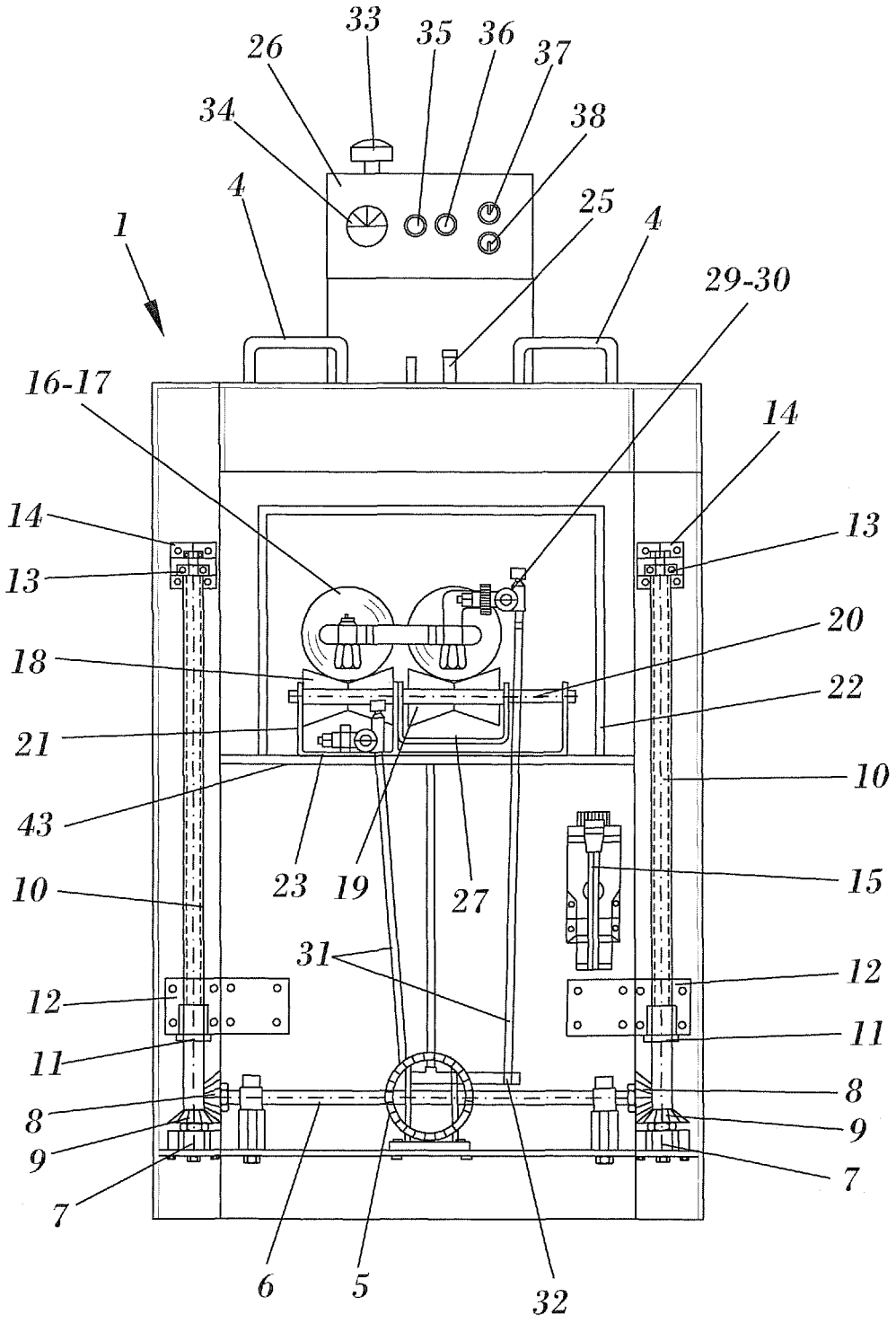
FIGS. 6 and 7 show the new cabinet adapted for the filling, in each operation, of two bottles (16), (17): in said examples, twin bottles (FIG. 6) and a pair of separate bottles of greater size (FIG. 7), respectively.
Figure 7:
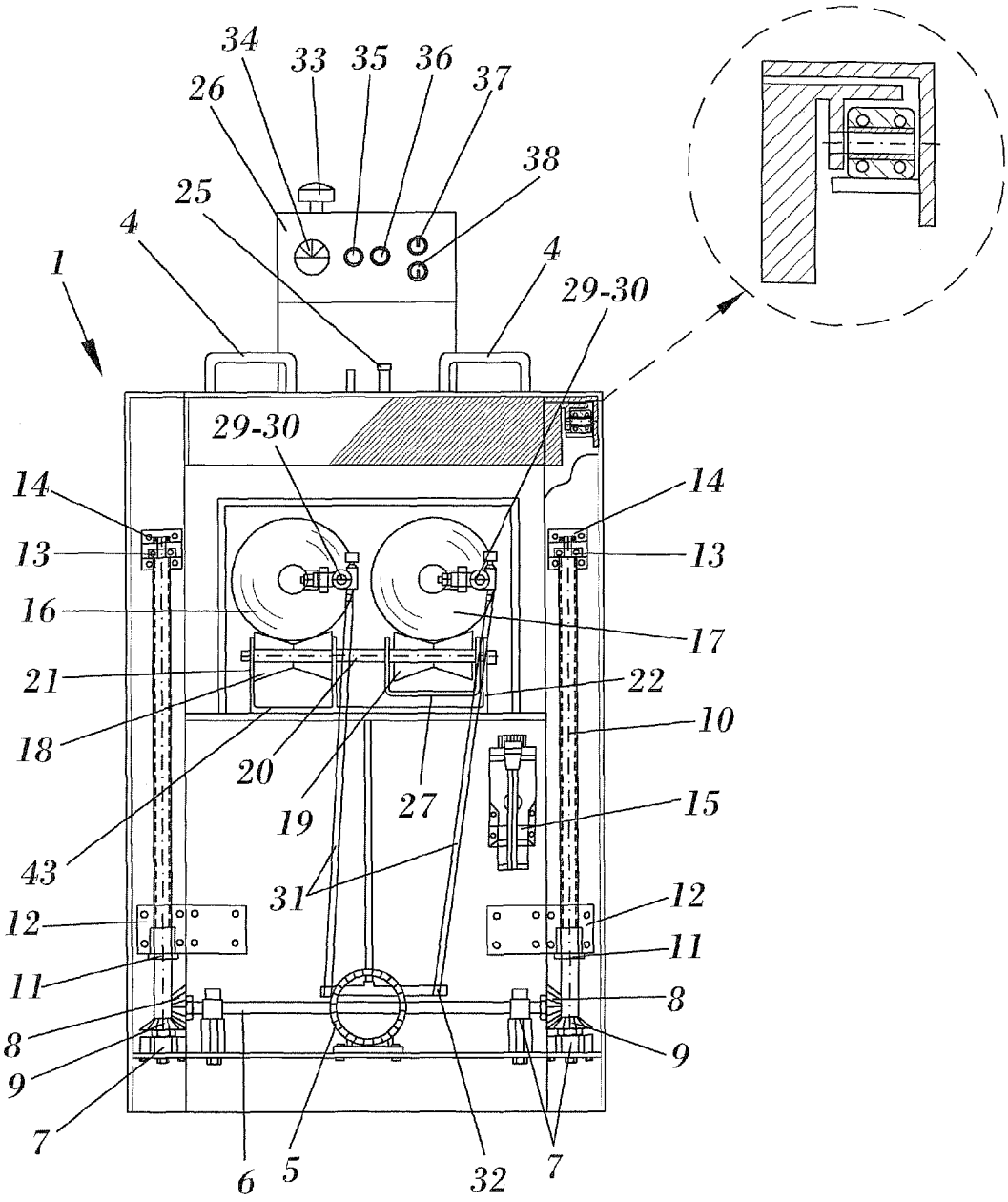
Figure 8:
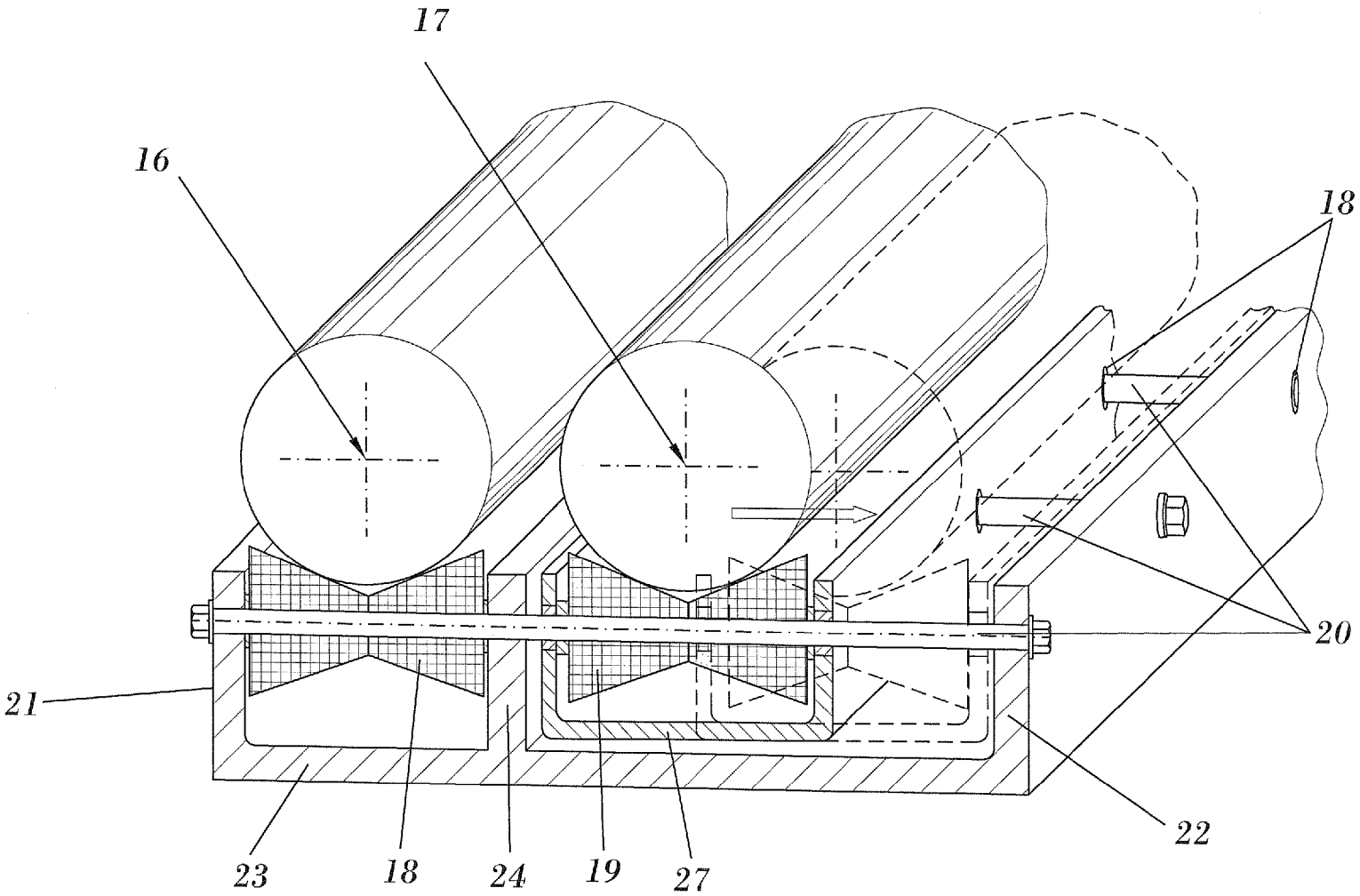
FIG. 8 is a detail in perspective of the unit of rollers for support of the bottles (16), (17) for filling them in horizontal position.

The bottles (16), (17) remain with their taps (29) located on the front, upper and inner part of the body (1) of the cabinet (FIG. 4), and for their filling, receive the coupling of the filling taps (30) (FIG. 5), disposed in number of four, according to FIGS. 3 and 3*b*, or of two, according to FIGS. 6 and 7.

The filling taps (30) (FIGS. 4 and 5) are fed through respective flexible tubular hoses (conduits) (31), associated to an air collector (32) to which, in turn, the air intake (25) is connected, pertaining to the installation of an air compressor not shown in the drawings. Conventionally, suitable purgers will be used.

The new cabinet has a control panel (26) which includes an emergency switch (33) (FIG. 7), a filling gauge (34), a compressor filling switch (35), a stop switch (36), and switches (37), (38) for the vertical movement of the front door (2) and the horizontal movement of the upper door (3) simultaneously. The control panel (26) mainly occupies an upper part of the body (1).

The passive safety of the described cabinet with respect to occasional explosions due to the release of air at high pressure and breakage of bottles (16), (17) is guaranteed by the sturdiness of the walls of the body (1) and of the doors (2), (3), made mainly of iron plate of a suitable thickness. The objective is the personal safety of the users of the filling cabinet.

On the inner, lower and rear parts of the body (1) (FIGS. 4 and 5) there is a tube or camera (42) (FIG. 5) with escape openings for the shock wave which would be produced in the case of explosion or breakage of one or more high-pressure air bottles (16), (17).

To be included among the advantages of the filling cabinet described are, in addition to its safety and ease of use, its portability and the possibility of simultaneously filling bottles (16), (17) of different types and at different values of air pressure. It is not necessary to lift and maintain an upper door which may injure the user of the cabinet if it falls, or use pins or other auxiliary elements to position said upper door, as is the case with other types of cabinets for filling bottles.

All that does not affect, alter, change or modify the essence of the cabinet described will be variable by the holder of this patent, for the purposes of the protection provided by the same. Modifications may not be introduced by other persons with the purpose of eluding the protection of this patent, without authorization of the holder.

The invention claimed is:

1. Safety cabinet for filling self-contained breathing apparatus bottles, for the extemporaneous filling of bottles containing compressed air for artificial breathing equipment for persons in water sports and professional activities, comprising:

a body in box shape having a front face and equipped with doors, allowing functional access to its interior;

a work bench housed inside the body;

a plurality of fixed horizontal shafts supported by the work bench and located in transverse direction with respect to the front face of the body;

a plurality of pairs of troncoconical rollers paired at their smaller bases and able to turn freely with respect to the plurality of fixed horizontal shafts thereby defining groups of parallel rollers suitable for receiving and sustaining the bottles to be filled;

a plurality of filling taps and a plurality of intake taps located inside the body; and a plurality of feed chutes having one end joined to a common air collector and its opposite end joined to the filling taps, the common air collector connected to an outer installation generating compressed air, allowing compressed air to flow to the filling taps and to the intake taps.

2. The cabinet of claim 1, wherein a group of the plurality of pairs of troncoconical rollers cannot move axially, and another group of the plurality of pairs of troncoconical rollers has adjustable axial position, allowing the settling of the bottles of different sizes in a filling position.

3. The cabinet of claim 1, wherein:

a) the plurality of pairs of troncoconical rollers are mounted on the fixed horizontal shafts parallel and equidistant, the fixed horizontal shafts being supported on a common support in box shape having side faces and a partition between the side faces, and the partition being parallel to the faces;

b) a group of the plurality of troncoconical rollers cannot move axially but can turn freely on the fixed horizontal shafts located between one of the side faces and the partition;

c) a group of the plurality of troncoconical rollers having adjustable axial position is contained first inside a channel of rectangular section support having side faces and perforations, the fixed horizontal shafts passing through the perforations on the channel of rectangular section support; and d) a space between the partition and one side face of the common support being of greater width than the distance between the partition and the other side face thereby allowing the channel of rectangular section support to move and the distances between the plurality of pairs of troncoconical rollers to be modified at will, according to a diameter of a bottle or diameters of twin bottles disposed horizontally over the common support.

4. The cabinet of claim 1, wherein the body in box shape has an upper base and lateral side; a front sliding door on its front side and an upper sliding door on its upper base, the front sliding door equipped with an operating mechanism for its ascending and descending vertical movement comprising:

a central electric motor;

a spindle having a cog wheel on one end;

an axle-shaft, extended on its two ends, each end having a cog wheel; and nuts attached to a support fixed on the front sliding door, the cog wheel of the spindle forming a conical gear assembly with the cog wheel of the axle shaft.

5. The cabinet of claim 4, wherein the upper door is equipped with two handles for its manual operation and sliding up rollers and respective lateral guides on the upper base of the body.

6. The cabinet of claim 5, wherein a control panel located mainly on the outside of the body comprises an emergency switch, a filling indicator gauge, an air compressor filling switch, a stop switch, and switches for the vertical movement of the front door and the upper door simultaneously.

7. The cabinet of claim 4, wherein the front door has an upper edge, the upper edge having a transversal roller for the purpose of initial support for the bottles in their insertion into the work bench.

8. The cabinet of claim 7, wherein the body has an inner part, a lower part and a rear part, each part having a chamber with escape openings for a shock wave that may occasionally result from an internal explosion or breakage of one or more bottles with highly compressed air.

9. The cabinet of claim 8, wherein a device for operation of the upper sliding door simultaneous with that of the front sliding door comprises a mechanism of a nut, a lead screw and an electric motor.

* * * * *